US006897407B2

(12) United States Patent
Gomez

(10) Patent No.: US 6,897,407 B2
(45) Date of Patent: May 24, 2005

(54) METHOD OF AND APPARATUS FOR THE ELECTRICAL RESISTANCE HEATING OF METALLIC WORKPIECES

(75) Inventor: Rafael Garcia Gomez, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 10/395,309

(22) Filed: Mar. 24, 2003

(65) Prior Publication Data

US 2003/0217991 A1 Nov. 27, 2003

(30) Foreign Application Priority Data

Mar. 22, 2002 (DE) ..... 102 12 820

(51) Int. Cl.[7] ..... C21D 9/62
(52) U.S. Cl. ..... 219/156
(58) Field of Search ..... 219/50, 156

(56) References Cited

U.S. PATENT DOCUMENTS

| | | | | |
|---|---|---|---|---|
| 1,979,111 A | * | 10/1934 | Kalschne | 219/50 |
| 2,972,043 A | * | 2/1961 | Stich | 219/156 |
| 3,737,618 A | * | 6/1973 | Arnosky | 219/156 |
| 3,806,697 A | * | 4/1974 | Gray | 219/156 |

FOREIGN PATENT DOCUMENTS

| | | |
|---|---|---|
| DE | 1 262 320 | 3/1968 |
| DE | 30 26 346 A1 | 2/1982 |

* cited by examiner

*Primary Examiner*—Clifford C. Shaw
(74) *Attorney, Agent, or Firm*—Herbert Dubno

(57) ABSTRACT

An electrode pattern is used to apply preheating and final heating electric current to a workpiece whose smaller regions are bridged, or otherwise controlled as to the temperature so that for the final heating, all parts of the workpiece have substantially the same temperature and hence substantially the same electrical conductivity.

14 Claims, 9 Drawing Sheets

METHOD OF AND APPARATUS FOR THE ELECTRICAL RESISTANCE HEATING OF METALLIC WORKPIECES

FIELD OF THE INVENTION

My present invention relates to a method of heating a metallic workpiece utilizing electrical resistance heating, to an apparatus for heating the workpiece and to a method operating that apparatus.

BACKGROUND OF THE INVENTION

It is desirable to be able to heat a metallic workpiece and particularly an elongated metallic workpiece to a greater extent in certain regions than in others or to be able to heat the workpiece in certain regions while other regions are cooled and then ultimately to bring the entire workpiece to a certain temperature. The heating or cooling may cause transformation of the workpiece structure or prevent transformation of the workpiece structure to increase or decrease hardness, to increase or decrease ductility or to change or retain other properties of the workpiece.

There are various known possibilities for heating metallic workpieces, for example, semifinished products, billets to be shaped, pressed articles, metal sections or full sections or tubes to enable parts thereof to participate in thermal modification of the structure or to modify characteristics of the workpiece resulting from a hot-forming process or to otherwise modify mechanical properties. The heating can, for example, be carried out in a continuous furnace whereby the individual workpieces are brought to a uniform shaping temperature which may be independent of the geometric configuration. The continuous furnace usually processes the workpiece for a certain time, which can be considerable depending upon the nature of the workpiece, and can result in the formation of scale on the workpiece which must be removed in a separate step, for example, by sandblasting.

The continuous furnace, of course, must occupy space commensurate with the duration of the treatment and thus the significant size of such a furnace can itself be a drawback.

Metallic workpieces can also be partially or completely heated by inductive processes. With inductive heating, however, especially with long workpieces, temperature gradients can develop which preclude temperature uniformity over different parts of the workpiece.

A metallic workpiece can also be heated conductively, i.e. by the passage of electric current directly through it so that the heat which is generated is a function of the current flow and the resistance of the workpiece. This technique has been used for strip in the form of a coil, bars of metal and like workpieces. In the case of coiled materials, the process can be a continuous one in which the strip is passed over a stretch in which the heating occurs between two electrodes in contact with the strip. Ends of the strip can be spliced together and the strip can be separated for rewinding it in a coil.

In the case of bars and like workpieces, individual workpieces can be heated in succession or a plurality of workpieces can be simultaneously heated. The conductive heating step can be carried out in a small space and at higher rates than furnace heating. However, when the workpiece is to be heated by electric resistance heating and does not have a constant cross section over its length, a problem arises in that at locations of smaller cross section the workpiece heats up much more quickly and much more strongly than at locations of greater cross section. The result is that temperature differences arise in the workpiece and to the point that there may be considerable distortion at the higher temperature smaller regions while at regions of greater cross section, the workpiece may not be brought to a sufficient temperature.

From DE 126 23 20 B a method of heating a steel block is known in which the workpiece is only preheated at its outer regions and the further heating to a thermal deformation temperature is effected by electrical resistance heating to correct nonuniformities of the workpiece structure. In DE 30 26 346 C2, the stretch annealing of workpieces utilizes the supply of electric current through the jaws which engage the workpiece to apply tension thereto so that these jaws also serve as electrodes.

Neither of these references discloses a solution to the above-mentioned problems of conductive heating with workpieces of nonuniform cross section.

OBJECTS OF THE INVENTION

It is, therefore, the principal object of the invention to provide an improved method of resistance heating for elongated metallic workpieces which enables all regions of the metal workpiece to be brought to a defined temperature level without overheating or underheating individual regions of the workpiece.

Another object of the invention is to provide an improved apparatus for carrying out that method and an improved method of operating such an apparatus.

It is also an object of the invention to provide a method of and an apparatus for the heating of metallic workpieces whereby drawbacks of earlier techniques are avoided.

SUMMARY OF THE INVENTION

These objects and others which will become apparent hereinafter are attained, in accordance with the invention in a method of heating an elongated metallic workpiece having regions of relatively large cross section and other regions of relatively small cross section distributed along a length of the workpiece. In accordance with one aspect of the invention the method comprises the steps of:

a) passing an electric current through the workpiece to resistively heat the workpiece;

b) conductively bridging regions of smaller cross section of the workpiece so that the conductively-bridged regions are heated at most to a lesser extent than nonbridged regions while nonbridged regions are heated by the passage of the electric current therethrough to a certain temperature level whereby certain parts of the workpiece are heated or cooled in a targeted manner; and c) thereafter heating the entire workpiece to provide a defined temperature level in all parts of the workpiece.

In accordance with another aspect of the invention, the method of electrically resistance heating the metallic workpiece is intended to heat the metallic workpiece in a targeted manner only in defined regions or to cool the metallic workpiece only in defined regions and to then finish heating the entire workpiece to a defined temperature level in all regions of the workpiece. This is accomplished in that regions of the workpiece which have relatively small cross sections by comparison with other regions of the workpiece are cooled so that they have a lower temperature than the regions of higher cross sections during the resistance heating of the workpiece and after which the entire workpiece is heated.

The smaller cross section regions of the workpiece are shunted by conductors during the resistance heating so that they are not only heated to a substantial lesser extent than the nonshunted regions which carry the full current of the resistance heating, but can also be heated to some extent by the electric current. The preheated larger cross section regions are subject to a reduction in the electrical conductivity with heating until the specific resistance of the more heated regions approaches the specific resistance of the colder or less heated regions and a uniform resistance value is provided in spite of the larger and smaller cross sections along the length. Thus apart from a targeted increase in temperature at the larger cross section portions and for exactly defined parts of the workpiece, there is also a temperature-dependent variation for the conductivity of the metal which is utilized so that the electrical resistance will be greater in the smaller cross section regions than in the regions of larger cross sections. As a consequence, the metallic workpiece will heat up more quickly in the regions of smaller cross section than in the regions of larger cross section.

When the metal heats, of course, the electrical conductivity drops for certain materials. Conversely, the electrical conductivity increases the colder the metal is. With a preheating or targeted cooling, the different parts of the workpiece with different cross section can have different specific resistance values so as to equalize the resistance over the length of the workpiece. The entire workpiece can then be heated after equalization of the resistance therealong so that for the heating of the entire workpiece, the workpiece can be treated as having the same resistance level along this entire length so that all regions are equally heated in the final step or are brought to the desired higher final temperature.

The heating of the entire workpiece is thus a uniform heating over the entire length of the workpiece and over the regions of smaller cross sections and the regions of larger cross sections, thereby eliminating the possibility of overheating in the regions of small cross sections and underheating in the regions of larger cross sections.

Thus the shape of the workpiece does not matter and it can be a billet or slab, a previously shaped workpiece, a forging blank, an extrusion press section or the like. In the case of a nonplanar engagement surface for the electrodes which are spaced apart along the length of the workpiece, the electrodes need only match the shape of the workpiece if they are to engage highly contoured portions of the workpiece.

According to an important aspect of the invention, the smaller cross section portions of the workpiece can be cooled so that the electrical conductivity at the cooled regions will increase and correspondingly the electrical resistance will drop, thereby utilizing the temperature gradient which exploits cooling to the same effect as the local heating. The regions of higher cross section will then, of course, have higher temperatures, either because they are not subject to cooling or because they have been heated to a greater extent.

The resistance values of the cooled regions and the resistance values of the uncooled regions of larger cross section can generally be equal following the initial steps and for the final heating operation so that ultimately the electric current is passed through a workpiece such that all of the regions can be heated to the desired higher temperature uniformly. The electric resistance heating is in this case as well, uniformly over the length of the workpiece so that an overheating of regions with smaller cross sections and underheating of regions with larger cross sections can be avoided. As the cooling medium for the preheating, cold air, nitrogen or oil may be used and the cooling may be direct cooling by directing the fluid onto the workpiece at the location at which it is to be cooled.

For the targeted preheating of partial regions with larger cross sectional areas, electrodes can be applied in an appropriate pattern to the surface of the workpiece and between selected electrodes a targeted voltage can be applied while the smaller cross section regions are electrically bridged. According to a feature of the invention, thermal bridges can be provided over the smaller cross section regions at which excessive heating is to be avoided. Such thermal bridges across the smaller cross section regions can abstract heat therefrom.

Depending upon the configuration of the workpiece, therefore, electrode pairs can be applied so that they straddle the regions to be preheated. Electrical current flow is then passed through the workpiece between these pairs of electrodes. To reduce the current flow in the smaller cross section parts or to suppress current flow in these regions, electrical shunts can be provided across them or these regions can be thermally bridged by, for example, ceramic bodies.

According to a feature of the invention, the heating of the larger cross section regions is carried out by varying the current flow through the larger cross section region so that the temperature increase compensates for the difference in electrical resistance values across the different cross section parts.

The electrodes of the electrode contact pattern are so arranged that the electric current generally flows longitudinally along the longitudinal axis of the workpiece. With very large workpieces in the sense of having wide or thick regions by comparison to the length, the electrodes of the electrode contact pattern can be so disposed on the workpiece that the current will flow substantially transversely or at an inclination to the longitudinal axis of the workpiece so as to improve the heating efficiency.

Since the metallic workpiece elongates as a result of heating, it is advantageous to apply tension to the workpiece during the electrical resistance heating so as to counteract distortion or the length of the workpiece.

According to the invention, the preheating and final heating can be carried out in the same work station. In that case either the metallic workpiece can be movable relative to the electrode or the electrodes should be movable with respect to the workpiece so that the preheating and finish heating take place over different regions of the workpiece. It is however possible to arrange the apparatus so that the preheating and final heating take place in separate work stations, preferably in a common cell and that the shaping of the workpiece take place in the final heating station or a separate station also preferably within that cell.

The preheating or final heating of the workpiece can, in accordance with another feature of the invention, also take place during the transfer of the workpiece to the shaping tool (i.e. the shaping dies) and/or during the transfer of the workpiece to the hardening tool, e.g. the pair of dies between which the workpiece is held during the hardening process. The tool itself may be a transport tool according to the invention.

In order to avoid scale formation on the metallic workpiece during the heating steps, the method of the invention can be carried out under a protective gas atmosphere under vacuum. That eliminates the need for scale removal by, for example, sandblasting.

The apparatus for effecting the resistance heating according to the invention comprises an electrode assembly capable of applying a plurality of electrodes in an electrode contact pattern to the workpiece. The electrode contact pattern can include electrodes positioned for preheating of certain regions and the overall heating of the workpiece as well as means for cooling defined regions where a cooling process is applied. The means for heating and cooling constitute means for the targeted adjustment of the temperatures of different portions of the workpiece. The cooling means, of course, can subject those portions of smaller cross section to the flow of a cooling fluid, e.g. one of the cooling gases or liquids mentioned previously.

The electrodes can be provided with electrical bridging members or shunts for bridging portions of the workpiece of smaller cross section or thermal bridges, for example, bridges of ceramic material around a plate electrode. Conductive bridges may be composed of a material which is electrically more conductive than the metal of the workpiece. According to a feature of the invention, the electrodes can be applied by the gripper arms of a robot and one or more robots can be provided for handling the workpiece of transferring the workpiece between the working stations one of which may be a press or shaping station. Robots for this purpose significantly reduce the processing time. Gripper electrodes can engage edges of the workpiece and can form or be equipped with swingable electrode arms for applying the preheating and final heating electrode pattern and, for example, for swinging the preheating electrode pattern out of the way for final heating or shaping.

The electrodes can be provided on rollers or roller electrodes can be provided in addition to static or stationary electrodes and the movable electrodes can be controllable in a targeted manner to ensure the desired electrode pattern for preheating and heating.

The device according to the invention for heating a workpiece is preferably provided in combination with a hot forming system which can further shape preformed billets or members. Such members can be door impact absorbers for motor vehicles, shock absorbers and chassis parts, other vehicle parts or the like which must be subjected to heat treatment to provide the desired impact or collision responses. The tool for shaping them and for heating them can be provided in protective cells so that the scaling of steel parts or oxide formation on aluminum parts can be avoided. The tools can include shaping units as well as tools defined for the heat treatment of the workpieces to provide the desired hardness, yield or other qualities of the internal structure, and in conjunction with forging processes and further heat treatments.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
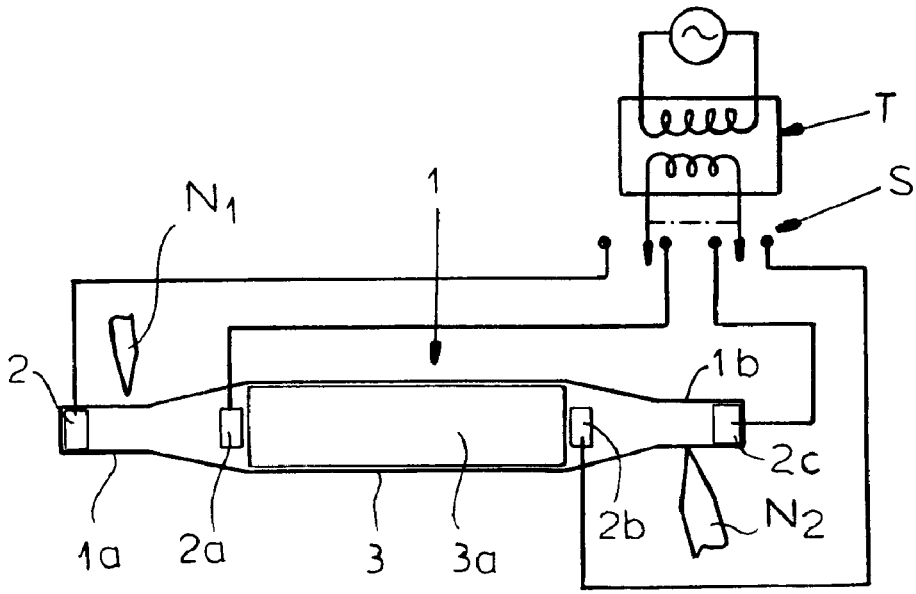
FIG. 1 is a diagrammatic illustration of a billet to be shaped and showing the positions of the electrodes for resistance heating thereof.

FIG. 1 shows a billet 1 adapted to be shaped in a press, composed of metal and having a pair of narrow ends 1*a* and 1*b* extending from a wide region 3 which is shaded at 3*a* to indicate the region at which preheating is to be effected.

The ends 1*a* and 1*b* are provided with electrodes 2 and 2*c* while the central region 3 to be preheated at 3*a* is straddled by the electrodes 2*a* and 2*b*. A power supply represented generally at T and including a transformer can be connected by a switching unit S to electrodes so that, for example, in one position of the ganged switches, the electrodes 2*a* and 2*b* are connected across the secondary winding of the transformer to exclusively heat the central region 3*a* by resistive heating. Simultaneously nozzles N1 and N2 can direct cold air, nitrogen or some other coolant onto the narrow regions 1*a* and 1*b*.

When the resistance of the narrow regions 1*a* and 1*b* is equal to the resistance of the central region 3*a*, the switching unit S can switch over to its second position in which the output of the secondary winding is applied to the end electrodes 2 and 2*c* so that the heating current passes through the entire workpiece and uniformly heats the latter to the final desired temperature. In this arrangement, therefore, the central region 3*a* of larger cross section is preheated using the two electrodes 2*a*, 2*b* positioned at intermediate locations along the workpiece while the narrow regions 1*a* and 1*b* are initially cooled and then heated together with the central region using the electrodes 2, 2*c*.

It will be understood that the apparatus is shown in the remaining figures may all have resistance heating power supplies such as the transformer shown in FIG. 1 and switching systems as there shown to enable selective energization of the electrodes.

Figure 2:
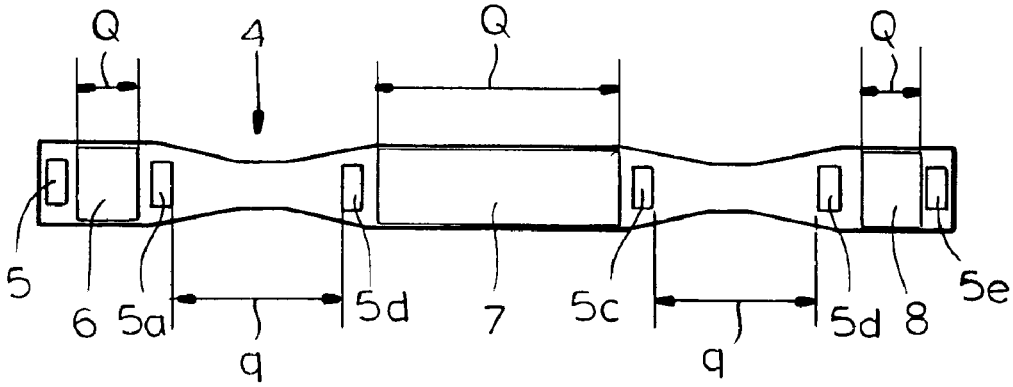
FIG. 2 is a view similar to FIG. 1 in which the workpiece has two narrow regions between a large central region and the opposite larger ends of the workpiece showing the locations of six electrodes used for the resistance heating thereof.

FIG. 2 shows a billet 4 with three regions of large cross section Q and two regions of smaller cross section q, the electrode pattern consisting of six electrodes (5, 5*a*, 5*b*, 5*c*, 5*d* and 5*e*) which engage the workpiece. The entire workpiece is heated when the electric current is passed between the electrodes 5 and 5*e* at the ends and greater electrode currents are passed between the electrodes 5 and 5*a*, 5*b* and 5*c* and 5*d* and 5*e* to heat the larger cross section regions Q so that these regions 6, 7 and 8 can be preheated. The region q can be resistively heated to a lesser extent or can be cooled by nozzles such as were shown at N1 and N2 respectively.

Figure 3:
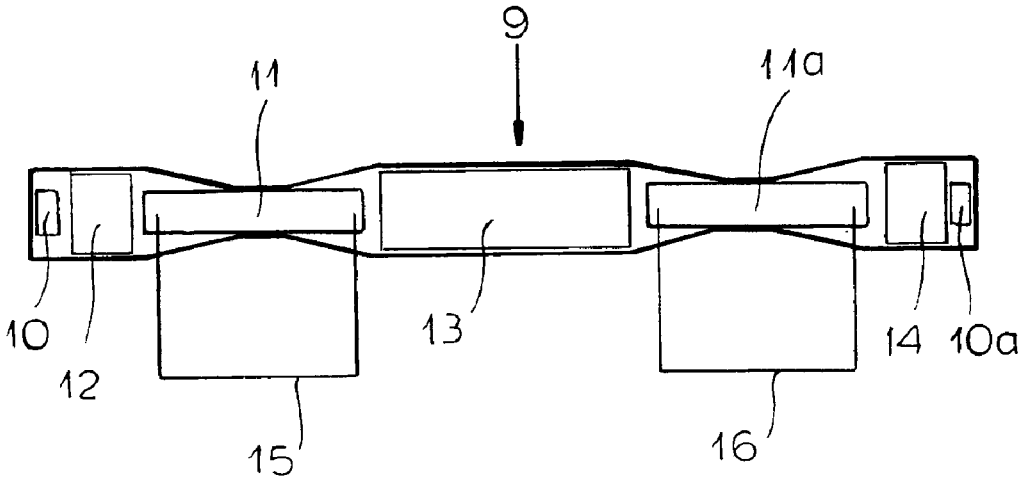
FIG. 3 is a diagram showing a workpiece similar to that of FIG. 2 having three preheated regions and two small and two wide electrodes.

FIG. 3 shows another method of heating a workpiece having the shape of the workpiece 4 shown in FIG. 2.

The workpiece 9 of FIG. 3 is to have three preheated regions 12, 13 and 14 and for that purpose the smaller cross section regions 11 and 11*a* are bridged, for example, by conductors which can be the especially long electrodes 11 and 11*a* and which generally will have a conductivity greater than the conductivity of the metal. The current flow patterns bypassing the narrow regions are represented at 15 and 16 in FIG. 3 and in addition to the long electrodes 11 and 11*a*, short electrodes 10 and 10*a* are provided at the ends so that the current for heating the entire workpiece can be passed through the length thereof utilizing these electrodes.

Figure 4:
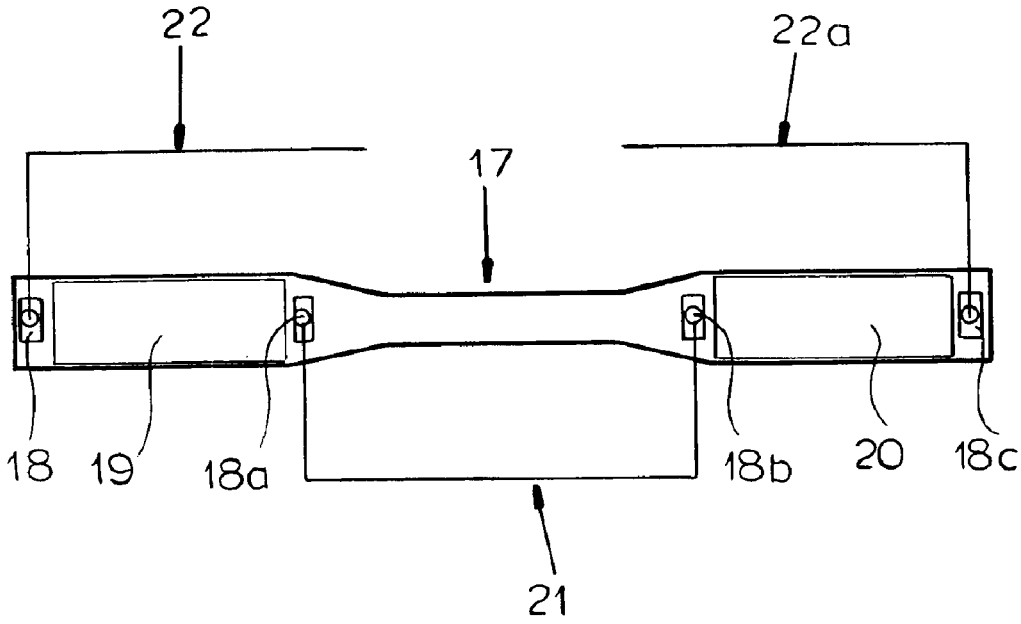
FIG. 4 is an illustration of a system for the resistance heating of a billet having a narrow central region and two wide end regions.

FIG. 4 shows a workpiece 17 with a narrow central region and two wider end regions 19 and 20 which are to be preheated. The electrode contact pattern here utilizes four electrodes 18, 18*a*, 18*b*, 18*c*.

The four electrodes include two outer electrodes 18 and 18*c* at the ends of the workpiece and two inner electrodes 18*a* and 18*b* at the transitions between regions of larger to regions of small cross section. The two inner electrodes 18*a*, 18*b* are bridged by a cable 21 for the preheating stage to thereby bridge the central region and keep it cool. The current supply circuit is here represented by conductors 22 and 22*a*.

Figure 5:
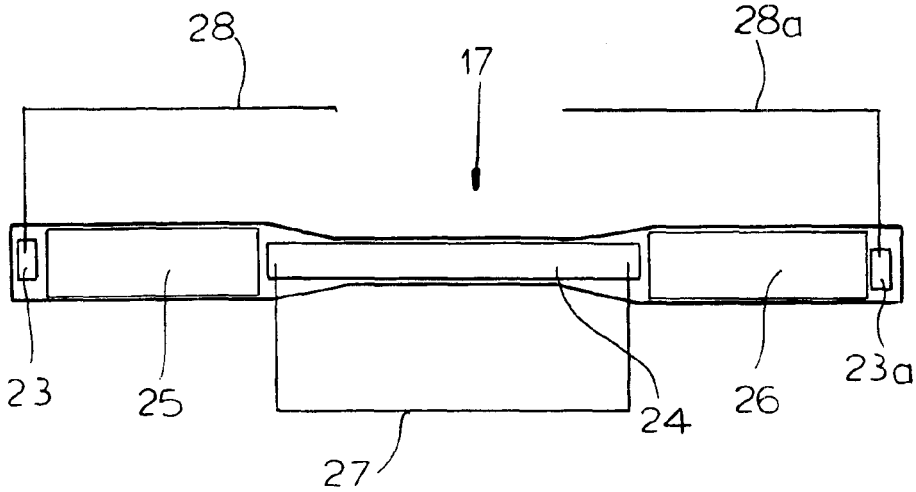
FIG. 5 is a diagram illustrating a system for heating a billet or workpiece similar to that of FIG. 4 but utilizing a wide central electrode as opposed to the narrow electrodes of FIG. 4.

FIG. 5 shows another workpiece 17 like that of FIG. 4 with two preheated regions 25, 26 and small electrodes 23, 23*a* at the respective ends and a wide electrode 24 in the middle. The central region is here bridged by an electrode with higher conductivity in the workpiece metal or by a conductor 27 of such higher conductivity. For example the electrode or the conductor 27 may be composed of copper. A voltage supplied to the outer electrodes 23, 23*a* via the circle 28, 28*a* and current flows between the outer electrodes and through the intermediate electrode 24 without resistively heating the cross section region. The regions of greater cross section are preheated.

Figure 6:
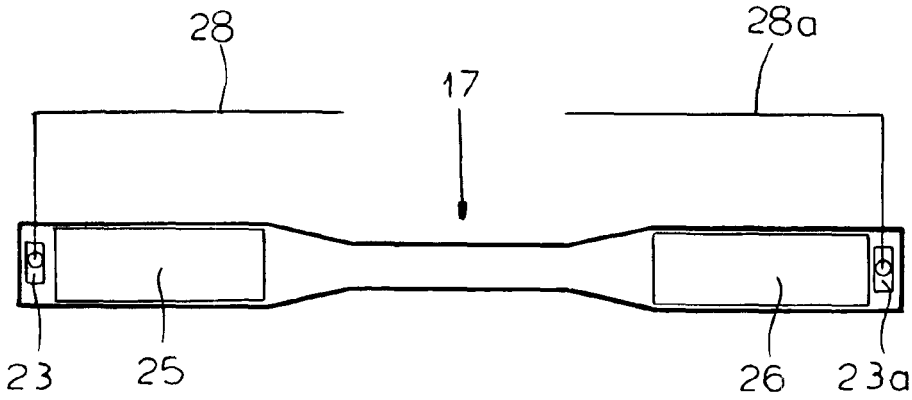
FIG. 6 is a diagram showing another system for the heating of a workpiece similar in layout to that of FIGS. 4 and 5 utilizing only electrodes at the opposite ends.

FIG. 6 shows another workpiece 17 of the shape illustrated in FIGS. 4 and 5 but an electrode pattern in which the intermediate electrode has been removed. It is assumed here that the two large cross section regions 25 and 26 have already been preheated. The external circuit 28, 28*a* can then be used to pass a resistive heating current through the entire workpiece for finish heating.

Figure 7:
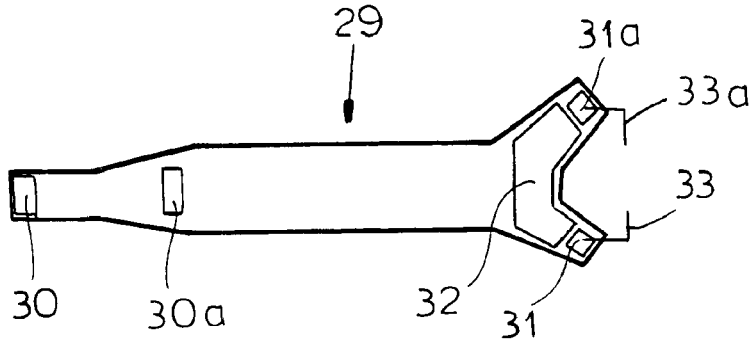
FIG. 7 is a diagram illustrating another system for heating a workpiece with fishtail ends utilizing four electrodes and adapted to provide a single preheated region.
Figure 8:
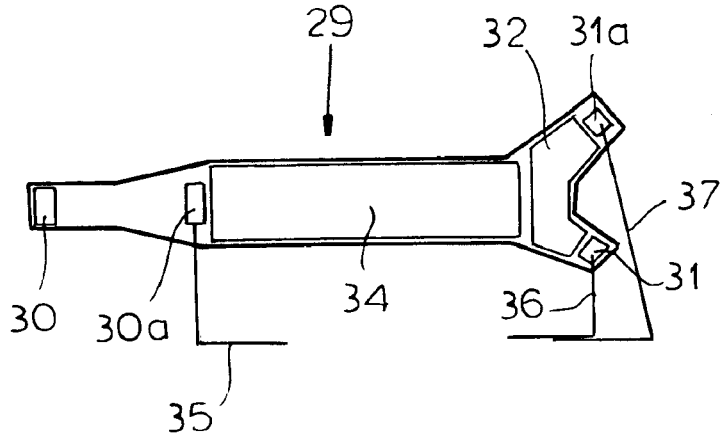
FIG. 8 is a diagram of a system for the resistance heating of workpiece similar to that of FIG. 7 but with two preheated regions.
Figure 9:
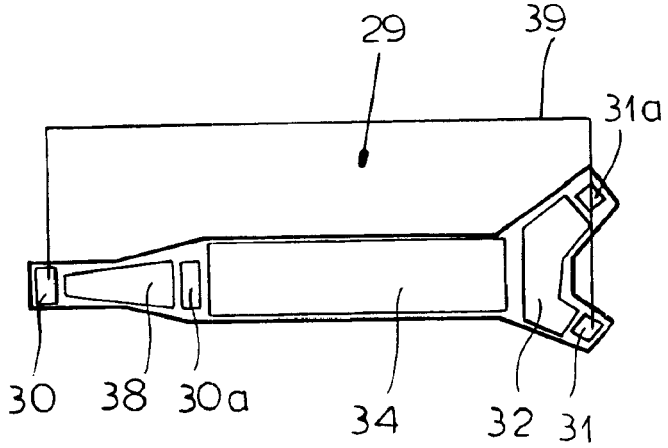
FIG. 9 is a diagram for the system of a workpiece similar to that of FIGS. 7 and 8 but having three preheated regions.

FIGS. 7, 8 and 9 show workpiece with a fishtail configuration. The workpiece 29 has a small end and a fishtail end which are to have different heating states. The electrode pattern in each case has a small electrode 30 at the small end and electrodes 31 and 31*a* at the branches of the fishtail. The steps in heating the workpiece will be apparent from these figures. Initially a current is applied at 33, 33*a* to the fishtail end to preheat the end region 32. Then as shown, a current is applied through the circuit 35, 36 between the intermediate electrode 30*a* and the electrodes 31, 31*a* to heat a further region 34 of the workpiece. Finally, in FIG. 9 the circuit 39 caries the current to flow from electrode 30 at the small end to the electrons 31, 31*a* to heat the entire workpiece to the final heating temperature.

Figure 10:
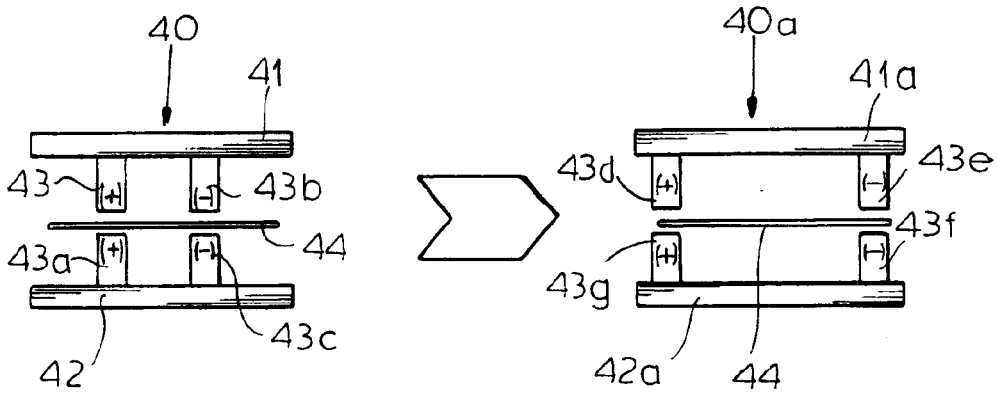
FIG. 10 is an elevational view diagrammatically illustrating an apparatus for the resistance heating of a slab utilizing two separate stations for the preheating and final heating steps.

FIG. 10 shows an embodiment for the resistive heating for a workpiece using two distinct stations 40 and 40*a* and electrode patterns 43, 43*a*, 43*b*, 43*c* engageable with the workpiece 44 in one station and electrodes with a greater spacing at 43*d* through 43*f* for heating the entire workpiece in the final station. The electrodes are carried by plates 41, 42 or 41*a*, 42*a* and the two stations are represented at 40 and 40*a* respectively.

Figure 11:
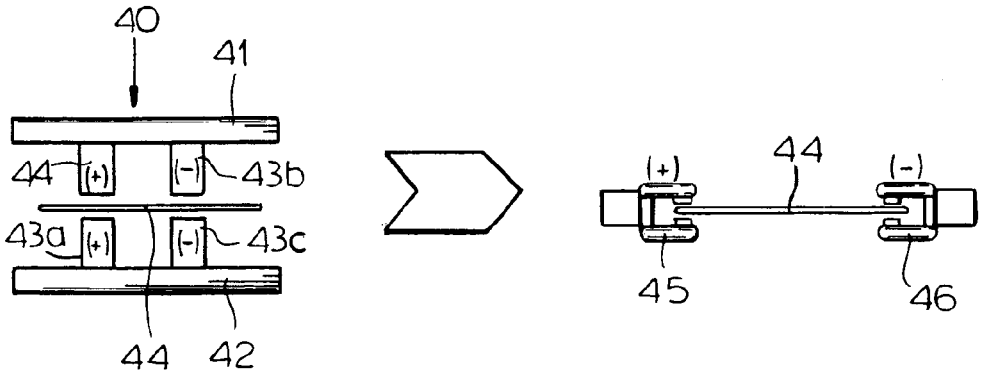
FIG. 11 is a view similar to FIG. 10 in which the preheating station corresponds to that of FIG. 10 but the final heating station is provided with jaws or grippers capable of displacement and simultaneously forming electrodes.

In FIG. 11, only the station 40 serves to preheat the central region of the workpiece 44 while the final heating is affected between grippers 45 sand 46 which are connected to a current source.

In this embodiment the final heating is effected during transfer of the preheating station to the shaping tool.

Figure 12:
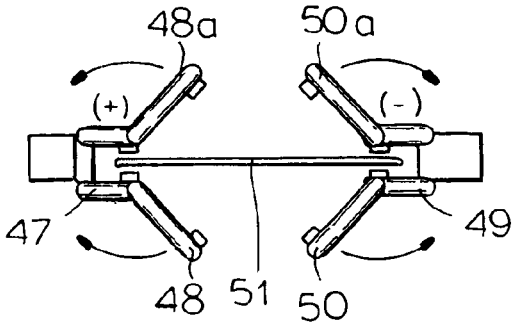
FIG. 12 is a diagram of an apparatus for the resistance heating of a slab utilizing two transport grippers which can simultaneously form electrodes and having two other pairs of electrodes.

FIG. 12 shows a pair of grippers 47, 49 which are configured as electrodes which can engage the workpiece 51 at respective ends for the final heating. Each gripper 47, 49, however, has additional arms 48, 48*a*, 50, 50*a* with electrodes to enable the workpiece 51 to be heated in the central region only.

Figure 13:
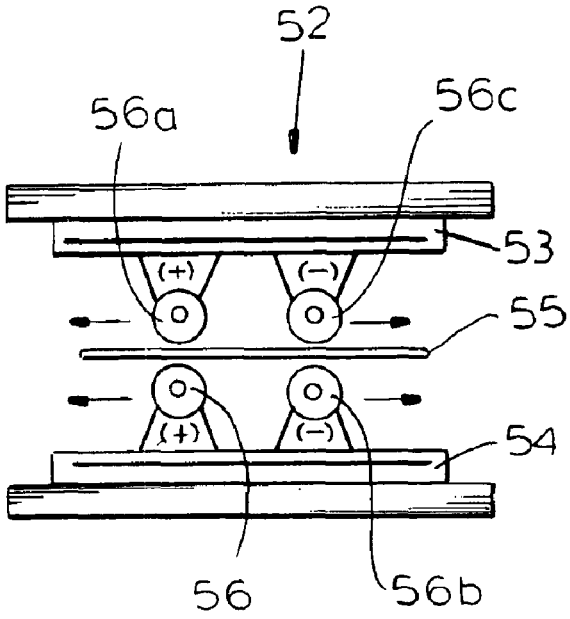
FIG. 13 is a diagram of an apparatus for the electrical resistance heating of a workpiece in which the electrodes are also formed as rollers.

FIG. 13 shows a device for the resistance heating of a workpiece 55 which comprises a pair of supports 53, 54 and four electrodes 56, 56*a*, 56*b*, 56*c* which are rollers. The workpiece 55 is clamped between the rollers on the upper and lower tools and the workpiece is drawn through the rollers to heat the workpiece regions between the rollers. The workpiece can easily be moved in this embodiment and the rollers have only a limited contact area.

Figure 14:
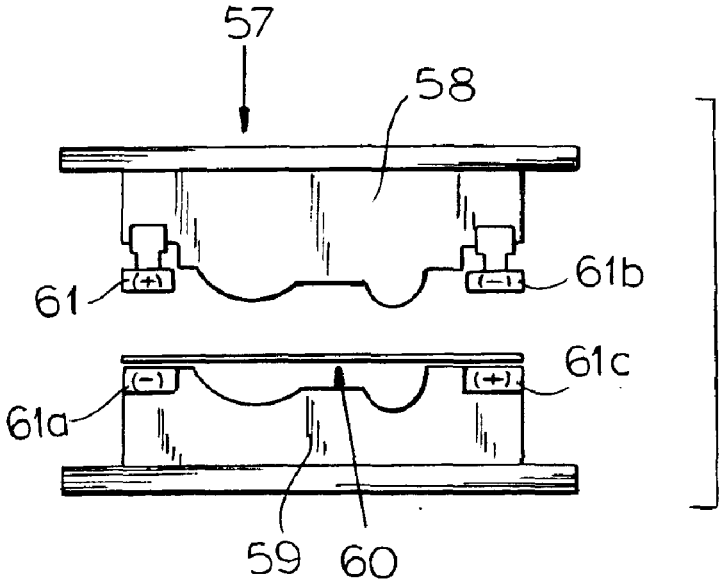
FIG. 14 is a side elevational view diagrammatically illustrating a combined heating and shaping apparatus.

FIG. 14 shows an embodiment wherein the combined resistance heating and shaping, between male and female dies, according to the invention. The upper tool 58 is contoured to form a male shaping die for a press 57 while the lower tool 59 forms the female die. Four electrodes 61, 61*a*, 61*b*, and 61*c* are provided outside the contoured region of the dies so that the workpiece 60 can both be resistively heated and shaped.

Figure 15:
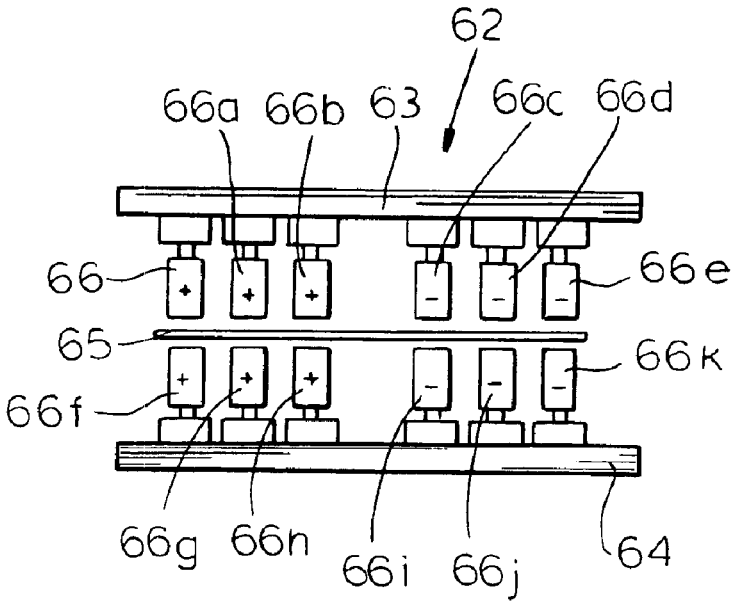
FIG. 15 is a view similar to FIG. 14 of an apparatus for the selective heating of various regions of a workpiece utilizing a multiplicity of electrodes which can be turned off and on, depending upon the regions to be heated.

FIG. 15 shows an agent whereby the contact pattern is comprised of a multiplicity of electrodes on the upper and lower tools 63, 64 and the electrodes 66, 66*a*, . . . 66*k*, can be selectively energized to heat different regions of the workpiece and ultimately heat the entire workpiece as may be required.

Figure 16:
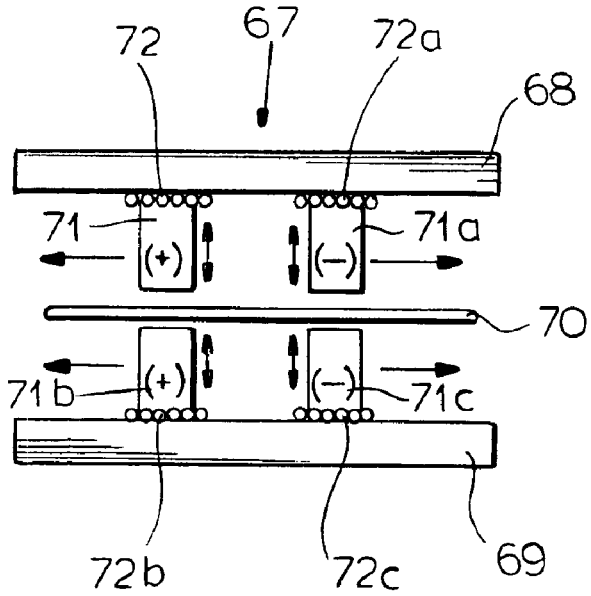
FIG. 16 is a side elevational view diagrammatically showing an apparatus for the resistance heating of a workpiece in which movable electrodes are provided.

FIG. 16 shows a device which similarly permits selective heating of different regions because the electrodes 71, 71*a*, 71*b*, 71*c* are provided on respective arrays of rollers on the upper and lower tools 68 and 69. The roller sets are represented at 72, 72*a* . . . 72*c*. The positions of the electrodes can thus be shifted for preheating and final heating.

Figure 17:
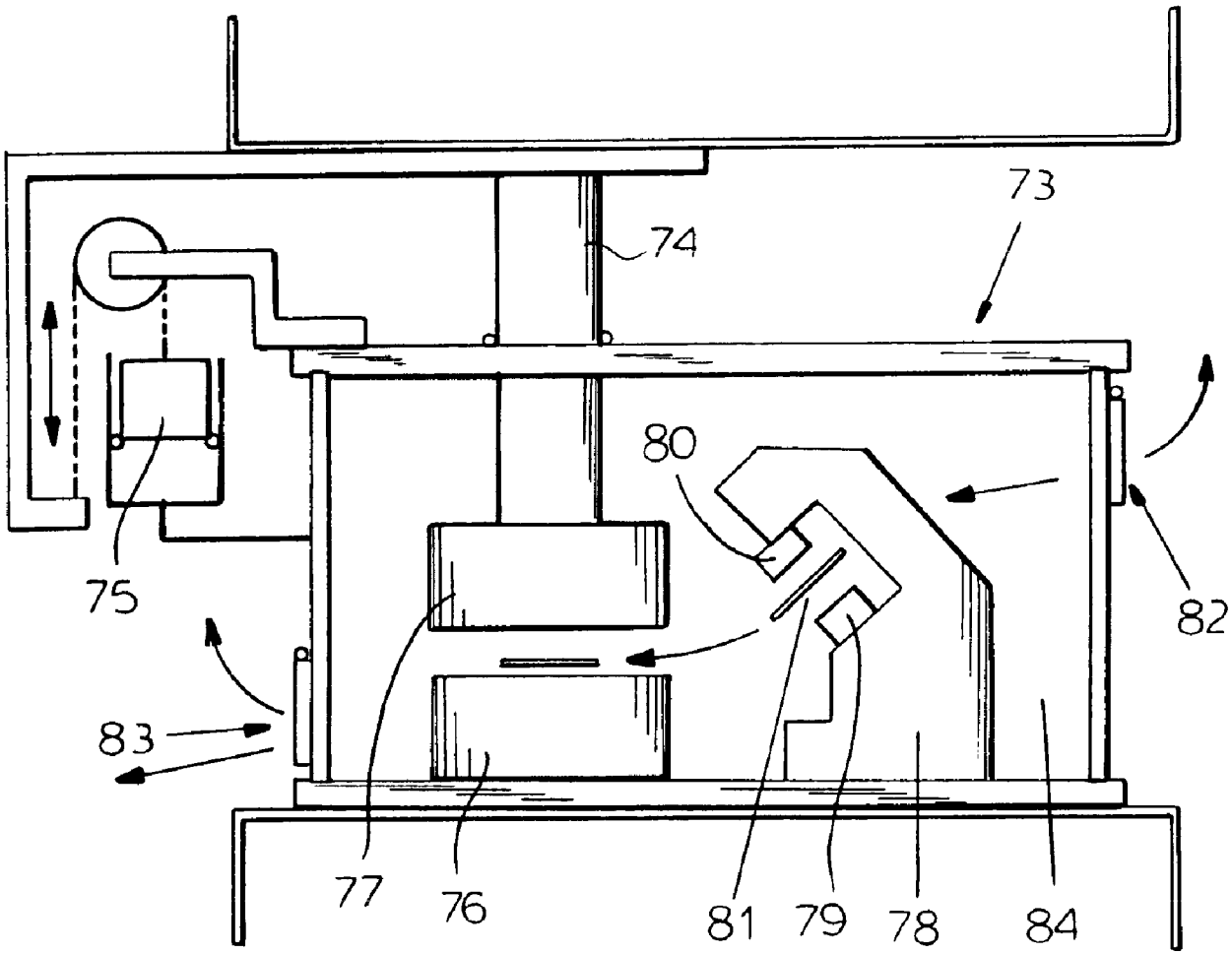
FIG. 17 is a schematic side view of an apparatus for the heating and shaping or hardening of a workpiece in a closed cell.

FIG. 17 shows an arrangement in which a closed cell 73 provided which has a heating unit 78 with two sets of electrodes 79, 80 and a shaping and hardening unit in the form of a press 74 whose tool 77 is juxtaposed with a lower tool 76. The ram can press the workpiece to shape it while the temperatures of members 76 and 77 are controlled to effect the hardening of the workpiece 81 when the latter is transferred to the press. The cell has doors 82, 83 to allow introduction of the workpieces and their removal and the cell can be filled and flushed with a protective gas or can be maintained under vacuum. The scaling of the workpiece is thereby precluded a volume equalization unit 75 is connected to the cell if the cell is pressurized with a protective gas. When a vacuum is used, the volume composition unit 75 is not required.

Figure 18:
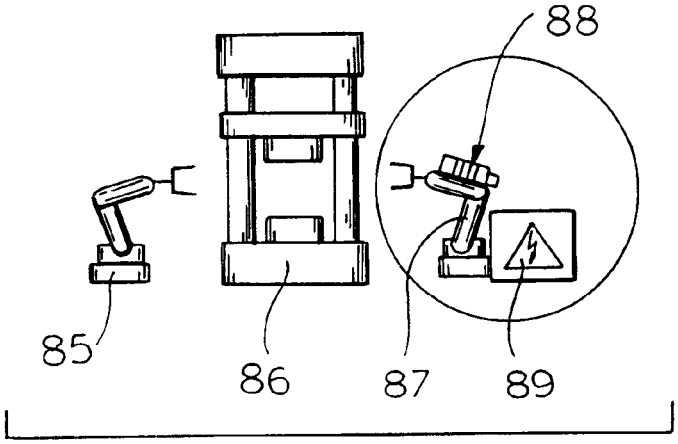
FIG. 18 is a side elevational view of an apparatus for shaping and hardening a workpiece having two robots in which one of these robots forms a transformer or has a transformer forming part of it.

FIG. 18 shows a heating and shaping system 86 in which two robots 85 and 87 manipulate the workpieces.

Figure 19:
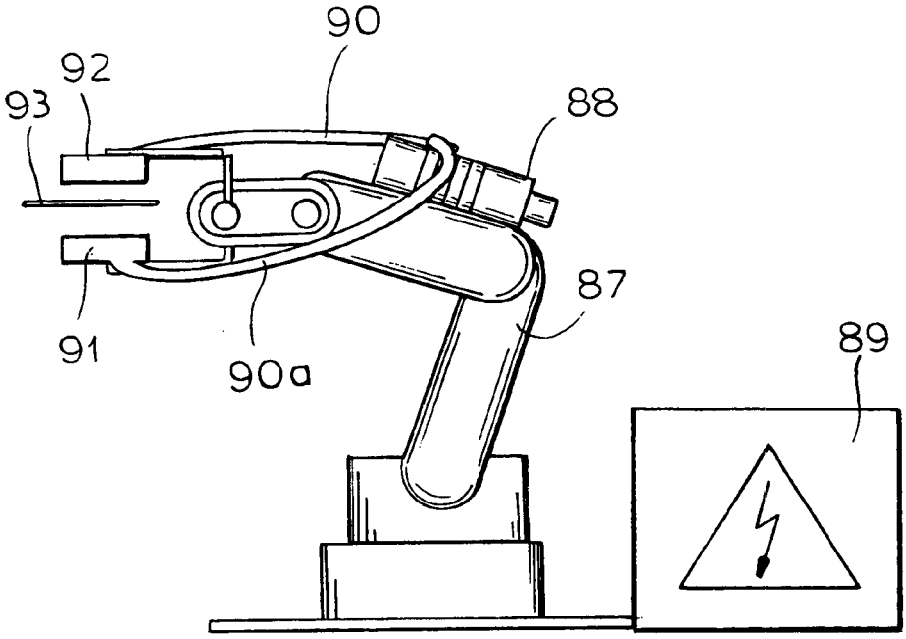
FIG. 19 is a detail of the apparatus of FIG. 18 showing the robot provided with the transformer.

One of the robots 87 has a transformer serving as a source for the resistive heating of the workpiece. The robot 87 having the transformer 86 is shown in greater detail in FIG. 19 and it will be apparent that two cables 90, 90*a* are connected to the electrodes 91, 92 from the transformer 88 so that during the transport of the workpiece 93 it can be preheated or final heated. The invention is applicable to all workpieces which are electrically conductive and can be used especially effectively with steel and the nonferrous metals like aluminum and magnesium.

I claim:

1. A method of heating an elongated metallic workpiece having regions of relatively large cross section and other regions of relatively small cross section distributed along a length of the workpiece, the method comprising the steps of:

a) passing an electric current through said workpiece to resistively heat said workpiece;

b) electrically or thermally bridging regions of smaller cross section of said workpiece by providing an electrical or thermal shunt thereacross so that the bridged regions are heated at most to a lesser extent than nonbridged regions while nonbridged regions are heated by the passage of the electric current therethrough to a certain temperature level whereby certain parts of the workpiece are heated or cooled in a targeted manner; and c) thereafter heating the entire workpiece to provide a defined temperature level in all parts of the workpiece.

2. The method defined in claim 1 wherein different temperatures are provided prior to step (c) in the large cross section regions and in the small cross section regions to adjust electric resistances therein to substantially the same resistance values.

3. The method defined in claim 1 wherein the workpiece is resistively heated by applying thereto a pattern of electrodes and passing an electric current through the workpiece between electrodes of said pattern and wherein at least to a substantial degree the current flow through said workpiece caused by said pattern of electrodes is transverse to a longitudinal axis of the workpiece.

4. The method defined in claim 1 wherein preheating of said workpiece in step (a) and final heating of the workpiece in step (c) are carried out in the same station.

5. The method of heating an elongated metallic workpiece having regions of relatively large cross section and other regions of relatively small cross section distributed along a length of the workpiece, the method comprising the steps of:

a) selectively heating said regions of relatively large cross section by passing an electric current thereto to resistively heat said regions of relatively large sections;

b) simultaneously cooling said regions of relatively small cross section by directing a coolant thereagainst so that they have temperatures below those of the regions of relatively large cross sections; and c) thereafter heating the entire workpiece by passing an electric current therethrough to provide a defined temperature level in all parts of the workpiece.

6. A method of heating an elongated metallic workpiece having regions of relatively large cross section and other regions of relatively small cross section distributed along a length of the workpiece, the method comprising the steps of:

a) passing an electric current through said workpiece to resistively heat said workpiece;

b) electrically or thermally bridging regions of smaller cross section of said workpiece by providing an electrical or thermal shunt thereacross so that the bridged regions are heated at most to a lesser extent than nonbridged regions while nonbridged regions are heated by the passage of the electric current therethrough to a certain temperature level whereby certain parts of the workpiece are heated or cooled in a targeted manner; and c) thereafter heating the entire workpiece to provide a defined temperature level in all parts of the workpiece, and wherein the preheating in step (a) or final heating in step (c) are carried out during transport of said workpiece with a transport tool.

7. An apparatus for the electric resistance heating of a metallic workpiece comprising a plurality of electrodes forming an electrode contact pattern and applicable to a metallic workpiece for passing electric current through at least selected portions of said workpiece; means including electrodes of said pattern for preheating selected regions of said workpiece by passing electric current through said selected regions and optional means for cooling regions of said workpiece; and means forming an electrical or thermal shunt, for bridging regions of smaller cross section for limiting resistance heating thereof.

8. The apparatus defined in claim 7 wherein said means for cooling includes means for directing a cooling fluid onto regions of said workpiece having a smaller cross section than regions which are preheated.

9. The apparatus defined in claim 8 wherein said means for bridging include materials having a greater electrical conductivity than metal of the workpiece.

10. The apparatus defined in claim 7, further comprising at least one robot having a gripper arm formed with at least part of said electrode contact pattern.

11. The apparatus defined in claim 10 wherein said robot is provided with means for heating said work piece while displacing said workpiece to a shaping tool.

12. The apparatus defined in claim 7 wherein said electrode contact pattern is provided on a gripper engageable with an edge portion of said workpiece.

13. The apparatus defined in claim 7 wherein said electrode contact pattern is formed by roller electrodes engageable with said workpiece.

14. The apparatus defined in claim 7 wherein said electrode contact pattern is formed by a multiplicity of electrodes which are selectively controllable.

* * * * *